US008123302B2

(12) United States Patent
Hall et al.

(10) Patent No.: US 8,123,302 B2
(45) Date of Patent: Feb. 28, 2012

(54) IMPACT TOOL

(75) Inventors: David R. Hall, Provo, UT (US); Ronald Crockett, Payson, UT (US); Scott Dahlgren, Alpine, UT (US); Tyson J. Wilde, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 285 days.

(21) Appl. No.: 12/021,051

(22) Filed: Jan. 28, 2008

(65) Prior Publication Data

US 2008/0115977 A1 May 22, 2008

Related U.S. Application Data

(63) Continuation of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, now Pat. No. 8,007,051, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,953, filed on Aug. 11, 2006, now Pat. No. 7,413,256, application No. 12/021,051, filed on Jan. 28, 2008, and a continuation-in-part of application No. 11/965,672, filed on Dec. 27, 2007, which is a continuation-in-part of application No. 11/686,831, filed on Mar. 15, 2007, now Pat. No. 7,568,770.

(51) Int. Cl.
*E21C 35/18* (2006.01)

(52) U.S. Cl. ..... 299/113; 299/111; 299/105

(58) Field of Classification Search ..... 299/105, 299/111, 113, 104
See application file for complete search history.

(56) References Cited

U.S. PATENT DOCUMENTS 2,124,438 A 7/1938 Struk
(Continued)

FOREIGN PATENT DOCUMENTS

DE 3500261 7/1986
(Continued)

*Primary Examiner* — John Kreck
(74) *Attorney, Agent, or Firm* — Brinks Hofer Gilson & Lione

(57) ABSTRACT

An impact tool for use with a driving mechanism, the impact tool including an impact tip formed from a super hard material and having an apex and an attachment end, with the attachment end being bonded to a cemented metal carbide substrate at a non-planar interface. The cemented metal carbide substrate is bonded in turn to the front end of a cemented metal carbide bolster. The carbide bolster is securable against an outer surface of a driving mechanism through a press fit.

20 Claims, 15 Drawing Sheets

U.S. PATENT DOCUMENTS

| | | | | | |
|---|---|---|---|---|---|
| 3,254,392 | A | | 6/1966 | Novkov | |
| 3,342,531 | A | * | 9/1967 | Krekeler | 299/107 |
| 3,342,532 | A | * | 9/1967 | Krekeler | 299/107 |
| 3,397,012 | A | | 8/1968 | Krekeler | |
| 3,512,838 | A | | 5/1970 | Kniff | |
| 3,627,381 | A | * | 12/1971 | Krekeler | 299/106 |
| 3,650,565 | A | | 3/1972 | Kniff | |
| 3,655,244 | A | | 4/1972 | Swisher | |
| 3,778,112 | A | * | 12/1973 | Krekeler | 299/104 |
| 3,830,321 | A | | 8/1974 | McKenry | |
| 3,942,838 | A | | 3/1976 | Bailey et al. | |
| 3,957,307 | A | | 5/1976 | Varda | |
| 4,098,362 | A | | 7/1978 | Bonnice | |
| 4,109,737 | A | | 8/1978 | Bovenkerk | |
| RE029,900 | E | | 2/1979 | Kniff | |
| 4,156,329 | A | | 5/1979 | Daniels | |
| 4,199,035 | A | | 4/1980 | Thompson | |
| 4,247,150 | A | | 1/1981 | Wrulich et al. | |
| 4,268,089 | A | | 5/1981 | Spence et al. | |
| 4,397,362 | A | | 8/1983 | Dice et al. | |
| 4,439,250 | A | | 3/1984 | Acharya et al. | |
| 4,465,221 | A | | 8/1984 | Schmidt | |
| 4,484,783 | A | | 11/1984 | Emmerich | |
| 4,489,986 | A | | 12/1984 | Dziak | |
| 4,497,520 | A | | 2/1985 | Ojanen | |
| 4,583,786 | A | | 4/1986 | Thorpe et al. | |
| 4,627,665 | A | | 12/1986 | Ewing et al. | |
| 4,647,111 | A | * | 3/1987 | Bronder et al. | 299/113 |
| 4,660,890 | A | | 4/1987 | Mills | |
| 4,669,786 | A | | 6/1987 | Morgan | |
| 4,702,525 | A | | 10/1987 | Sollami et al. | |
| 4,728,153 | A | | 3/1988 | Ojanen et al. | |
| 4,746,379 | A | | 5/1988 | Rabinkin | |
| 4,776,862 | A | | 10/1988 | Wiand | |
| 4,804,231 | A | | 2/1989 | Buljan et al. | |
| 4,811,801 | A | | 3/1989 | Salesky et al. | |
| 4,836,614 | A | | 6/1989 | Ojanen | |
| 4,850,649 | A | | 7/1989 | Beach | |
| 4,880,154 | A | | 11/1989 | Tank | |
| 4,893,875 | A | | 1/1990 | Lonn et al. | |
| 4,921,310 | A | | 5/1990 | Hedlund | |
| D308,683 | S | | 6/1990 | Meyers | |
| 4,932,723 | A | | 6/1990 | Mills | |
| 4,940,288 | A | | 7/1990 | Stiffler | |
| 4,951,762 | A | | 8/1990 | Lundell | |
| RE033,494 | E | | 12/1990 | Hindmarsh et al. | |
| 5,007,685 | A | | 4/1991 | Beach et al. | |
| 5,112,165 | A | | 5/1992 | Hedlund | |
| 5,141,289 | A | * | 8/1992 | Stiffler | 299/111 |
| 5,186,892 | A | | 2/1993 | Pope | |
| 5,261,499 | A | | 11/1993 | Grubb | |
| 5,303,984 | A | | 4/1994 | Ojanen | |
| 5,415,462 | A | | 5/1995 | Massa et al. | |
| 5,503,463 | A | | 4/1996 | Ojanen | |
| 5,720,528 | A | | 2/1998 | Ritchey | |
| 5,725,283 | A | | 3/1998 | O'Neill | |
| 5,730,502 | A | | 3/1998 | Montgomery, Jr. | |
| 5,738,698 | A | | 4/1998 | Kapoor et al. | |
| 5,837,071 | A | | 11/1998 | Andersson et al. | |
| 5,884,979 | A | | 3/1999 | Latham | |
| 5,934,542 | A | | 8/1999 | Nakamura et al. | |
| 5,935,718 | A | | 8/1999 | Demo et al. | |
| 5,944,129 | A | | 8/1999 | Jensen | |
| 6,051,079 | A | | 4/2000 | Andersson et al. | |
| 6,065,552 | A | | 5/2000 | Scott et al. | |
| 6,193,770 | B1 | | 2/2001 | Sung | |
| 6,199,956 | B1 | | 3/2001 | Kammerer | |
| 6,357,832 | B1 | | 3/2002 | Sollami | |
| 6,481,803 | B2 | | 11/2002 | Ritchey | |
| 6,508,516 | B1 | | 1/2003 | Kammerer | |
| RE038,151 | E | | 6/2003 | Penkunas et al. | |
| 6,644,755 | B1 | | 11/2003 | Kammerer | |
| 6,692,083 | B2 | | 2/2004 | Latham | |
| 6,702,393 | B2 | | 3/2004 | Mercier | |
| 6,732,914 | B2 | | 5/2004 | Cadden | |
| 6,733,087 | B2 | * | 5/2004 | Hall et al. | 299/113 |
| 6,786,557 | B2 | | 9/2004 | Montgomery, Jr. | |
| 6,851,758 | B2 | | 2/2005 | Beach | |
| 6,854,810 | B2 | | 2/2005 | Montgomery, Jr. | |
| 6,861,137 | B2 | | 3/2005 | Griffin et al. | |
| 6,880,744 | B2 | | 4/2005 | Noro | |
| 6,938,961 | B2 | | 9/2005 | Broom | |
| 6,962,395 | B2 | | 11/2005 | Mouthaan | |
| 7,234,782 | B2 | | 6/2007 | Stehney | |
| 2002/0070602 | A1 | | 6/2002 | Sollami | |
| 2002/0074851 | A1 | | 6/2002 | Montgomery | |
| 2002/0153175 | A1 | | 10/2002 | Ojansen | |
| 2002/0175555 | A1 | | 11/2002 | Mercier | |
| 2003/0137185 | A1 | | 7/2003 | Sollami | |
| 2003/0141753 | A1 | | 7/2003 | Peay et al. | |
| 2003/0209366 | A1 | * | 11/2003 | McAlvain | 175/427 |
| 2003/0234280 | A1 | | 12/2003 | Cadden et al. | |
| 2004/0026132 | A1 | | 2/2004 | Hall et al. | |
| 2004/0026983 | A1 | | 2/2004 | McAlvain | |
| 2005/0044987 | A1 | | 3/2005 | Takayama et al. | |
| 2005/0159840 | A1 | | 7/2005 | Lin et al. | |
| 2006/0125306 | A1 | | 6/2006 | Sollami | |

FOREIGN PATENT DOCUMENTS

| | | | |
|---|---|---|---|
| DE | 3818213 | | 11/1989 |
| DE | 4039217 | | 6/1992 |
| DE | 19821147 | | 11/1999 |
| DE | 10163717 | | 5/2003 |
| EP | 0295151 | | 12/1988 |
| EP | 0412287 | | 2/1991 |
| EP | 1574309 | | 9/2005 |
| GB | 2004315 | A | 3/1979 |
| GB | 2037223 | | 7/1980 |
| JP | 5280273 | A | 10/1993 |

* cited by examiner

IMPACT TOOL

RELATED APPLICATIONS

This application is a continuation of U.S. patent application Ser. No. 12/021,019, filed on Jan. 28, 2008, which is a continuation-in-part of U.S. patent application Ser. No. 11/971,965, filed Jan. 10, 2008, now U.S. Pat. No. 7,648,210, which is a continuation of U.S. patent application Ser. No. 11/947,644, filed Nov. 29, 2007, which is a continuation-in-part of U.S. patent application Ser. No. 11/844,586, filed Aug. 24, 2007, now U.S. Pat. No. 7,600,823. U.S. patent application Ser. No. 11/844,586 is a continuation-in-part of U.S. patent application Ser. No. 11/829,761, filed on Jul. 27, 2007, now U.S. Pat. No. 7,722,127. U.S. patent application Ser. No. 11/829,761 is a continuation-in-part of U.S. patent application Ser. No. 11/773,271, filed Jul. 3, 2007. U.S. patent application Ser. No. 11/773,271 is a continuation in-part of U.S. patent application Ser. No. 11/766,903, filed Jun. 22, 2007. U.S. patent application Ser. No. 11/766,903 is a continuation of U.S. patent application Ser. No. 11/766,865, filed Jun. 22, 2007. U.S. patent application Ser. No. 11/766,865 is a continuation in-part of U.S. patent application Ser. No. 11/742,304, filed Apr. 30, 2007, now U.S. Pat. No. 7,475,948. U.S. patent application Ser. No. 11/742,304 is a continuation of U.S. patent application Ser. No. 11/742,261, filed Apr. 30, 2007, now U.S. Pat. No. 7,469,971. U.S. patent application Ser. No. 11/742,261 is a continuation in-part of U.S. patent application Ser. No. 11/464,008, filed on Aug. 11, 2006, now U.S. Pat. No. 7,338,135. U.S. patent application Ser. No. 11/464,008 is a continuation in-part of U.S. patent application Ser. No. 11/463,998, filed on Aug. 11, 2006, now U.S. Pat. No. 7,384,105. U.S. patent application Ser. No. 11/463,998 is a continuation-in-part of U.S. patent application Ser. No. 11/463,990, filed on Aug. 11, 2006, now U.S. Pat. No. 7,320,505. U.S. patent application Ser. No. 11/463,990 is a continuation in-part of U.S. patent application Ser. No. 11/463,975, filed on Aug. 11, 2006, now U.S. Pat. No. 7,445,294. U.S. patent application Ser. No. 11/463,975 is a continuation-in-part of U.S. patent application Ser. No. 11/463,962, filed on Aug. 11, 2006, now U.S. Pat. No. 7,413,256. The present application is also a continuation-in-part of U.S. patent application Ser. No. 11/695,672, filed on Dec. 27, 2007, now U.S. Pat. No. 7,396,086. U.S. patent application Ser. No. 11/695,672 is a continuation-in-part of U.S. patent application Ser. No. 11/686,831, filed on Mar. 15, 2007, now U.S. Pat. No. 7,568,770. All of these applications are herein incorporated by reference for all that they contain.

BACKGROUND OF THE INVENTION

Formation degradation, such as asphalt milling, mining, or excavating, may result in wear on attack tools. Consequently, many efforts have been made to extend the life of these tools.

U.S. Pat. No. 3,830,321 to McKenry et al., which is herein incorporated by reference for all that it contains, discloses an excavating tool and a bit for use therewith in which the bit is of small dimensions and is mounted in a block in which the bit is rotatable and which block is configured in such a manner that it can be welded to various types of holders so that a plurality of blocks and bits mounted on a holder make an excavating tool of selected style and size.

U.S. Pat. No. 6,102,486 to Briese, which is herein incorporated by reference for all that it contains, discloses a frustum cutting insert having a cutting end and a shank end and the cutting end having a cutting edge and inner walls defining a conical tapered surface. First walls in the insert define a cavity at the inner end of the inner walls and second walls define a plurality of apertures extending from the cavity to regions external the cutting insert to define a powder flow passage from regions adjacent the cutting edge, past the inner walls, through the cavity and through the apertures.

U.S. Pat. No. 4,944,559 to Sionnet et al., which is herein incorporated by reference for all that it contains, discloses a body of a tool consisting of a single-piece steel component. The housing for the composite abrasive component is provided in this steel component. The working surface of the body has, at least in its component-holder part, and angle at the lower vertex of at least 20% with respect to the angle at the vertex of the corresponding part of a metallic carbide tool for working the same rock. The surface of the component holder is at least partially covered by an erosion layer of hard material.

U.S. Pat. No. 5,873,423 to Briese, which is herein incorporated by reference for all that it contains, discloses a frustum cutting bit arrangement, including a shank portion for mounting in, and to be retained by, a rotary cutting tool body, the shank portion having an axis, an inner axial end, and an outer axial end. A head portion has an axis coincident with the shank portion axis, a front axial end, and a rear axial end, the rear end coupled to the shank portion outer end, and the front end having a conical cavity therein diminishing in diameter from the front end toward the rear end. A frustum cutting insert has an axis coincident with the head portion axis, a forward axial end, a back axial end, and an outer conical surface diminishing in diameter from the forward end toward the back end, the conical cavity in a taper lock. In variations of the basic invention, the head portion may be rotatable with respect to the shank portion, the frustum cutting insert may comprise a rotating cutter therein, and combinations of such features may be provided for different applications.

BRIEF SUMMARY OF THE INVENTION

In one aspect of the invention, an impact tool includes an impact tip formed from a super hard material and bonded to a cemented metal carbide substrate at a non-planar interface. The cemented metal carbide substrate is bonded to a front end of a cemented metal carbide bolster. The carbide bolster is secured against an outer surface of a driving mechanism, such as a drum, through a press fit.

The super hard impact tip may comprise a substantially conical surface with a side which forms a 35 to 55 degree angle with a central axis of the impact tool.

The substrate at the interface may comprise a tapered surface starting from a cylindrical rim of the substrate and ending at an elevated flatted central region formed in the substrate. The flatted region may comprise a diameter of 0.125 to 0.250 inches.

The bolster may comprise a stem with a diameter of 0.250 to 1.00 inches. The bolster may also comprise a stem that is adapted to be press-fit into the drum. The stem may comprise a length of 35 to 100 percent of the length of the bolster. Alternatively, the bolster may comprise at least one bore opposite the front end. The bore may be tapered. In addition, the bolster may comprise a base end with a base surface that is complementary with the outer surface of the drum or driving mechanism. One or more bolsters may be interlocked together. The bolsters may be interlocked through one or more flats formed into the side surfaces of each bolster.

The driving mechanism or drum may comprise a lug adapted to attach to the bolster. The lug may be threadedly attached to the drum and the carbide bolster. The lug may be press-fit into the carbide bolster. The lug may also comprise rod connected to a hydraulic pump, and which pumps is adapted to move the rod/lug and lock the carbide bolster against the drum.

The impact tool may be attached a driving mechanism forming part of a milling machine, a mining machine, a trenching machine, a pavement recycling machine or a crushing machine. The driving mechanism may also be a drill bit.

In another aspect of the invention, a high-impact resistant tool comprises an impact tip formed from a super hard material and bonded to a cemented metal carbide substrate at a non-planar interface. The cemented metal carbide substrate is bonded to a front end of a cemented metal carbide bolster. The cemented metal carbide bolster includes a locking mechanism adapted to attach the tool to a drum or driving mechanism.

BRIEF DESCRIPTION OF THE DRAWINGS

FIG. 1 is a cross-sectional diagram of an embodiment of a driving mechanism having plurality of impact tools mounted thereto.

DETAILED DESCRIPTION OF EXEMPLARY EMBODIMENTS

Figure 1A:
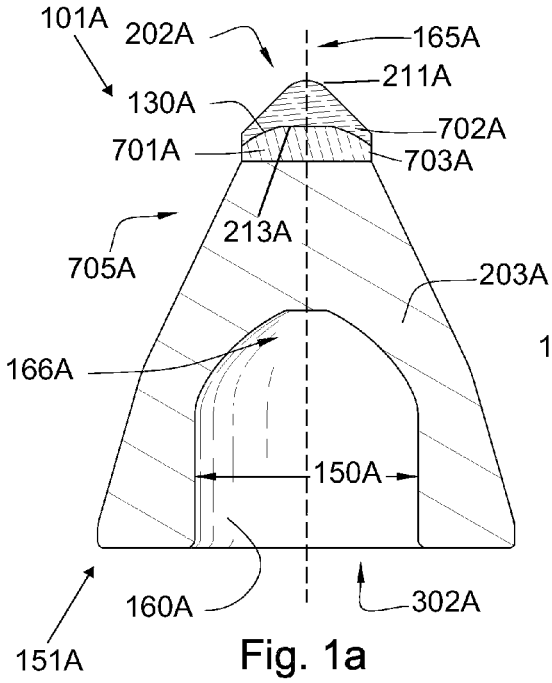
FIG. 1*a* is cross-sectional diagram of an embodiment of the impact tool.

In accordance with one exemplary embodiment, FIG. 1 is a cross-sectional diagram of a plurality of impact tools 101 attached to a driving mechanism, such as rotating drum 103, which in turn is connected to the underside of a pavement recycling machine 100. The recycling machine 100 may be a cold planer used to degrade man-made formations such as a paved surface 104 prior to the placement of a new layer of pavement. Impact tools 101 may be attached to the driving mechanism which rotates the impact tools 101 into engagement with the formation 104.

FIG. 1*a* is a cross-sectional diagram of an embodiment of an impact tool 101A. The impact tool 101A may comprise an impact tip 202A having an apex 211A and an attachment end 213A opposite the apex, and being formed from a super hard material. The super hard material may comprise diamond, polycrystalline diamond with a binder concentration of 1 to 40 weight percent, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, course diamond, fine diamond, nonmetal catalyzed diamond, cemented metal carbide, chromium, titanium, aluminum, tungsten, or combinations thereof. The super hard material may be a polycrystalline structure with an average grain size of 10 to 100 microns.

The attachment end 213A of the impact tip 202A may be bonded or brazed to a cemented metal carbide substrate 701A at a non-planar interface 130A. The substrate 701A at the non-planar interface 130A may comprise a tapered surface 702A starting from a cylindrical rim 703A of the substrate 701A towards a central axis 165A of the impact tool 101A, and ending at an elevated flatted central region formed in the substrate 701A.

The cemented metal carbide substrate 701A may be bonded to a front end 705A of a cemented metal carbide bolster 203A. The bolster 203A may also comprise at least one cavity 302A formed in its base end 151A. The inside surface 160A of the cavity 302A may comprise a section with a uniform diameter 150A, and a closed end 166A. The cavity 302A may be capable of receiving a shank in a press-fit arrangement.

Figure 1B:
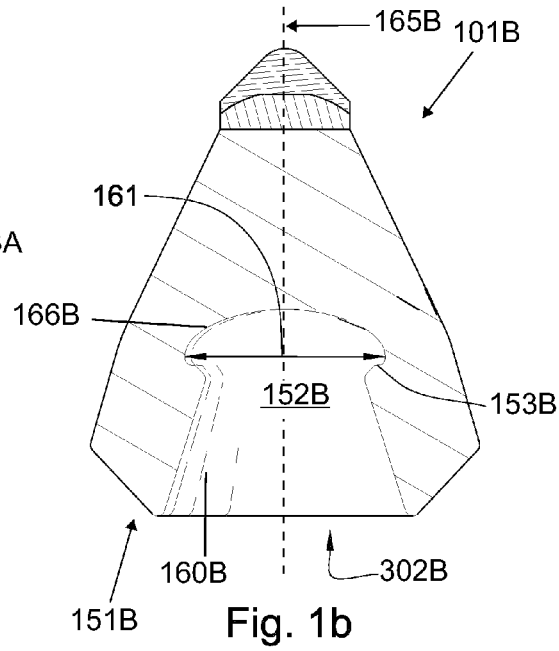
FIG. 1*b* is a cross-sectional diagram of another embodiment of the impact tool.
Figure 1C:
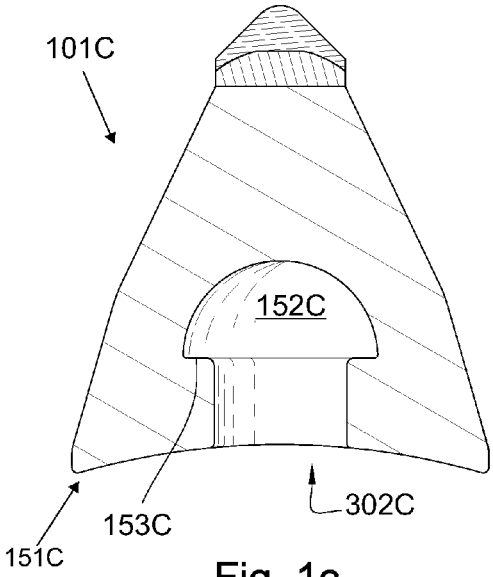
FIG. 1*c* is a cross-sectional diagram of another embodiment of the impact tool.
Figure 1D:
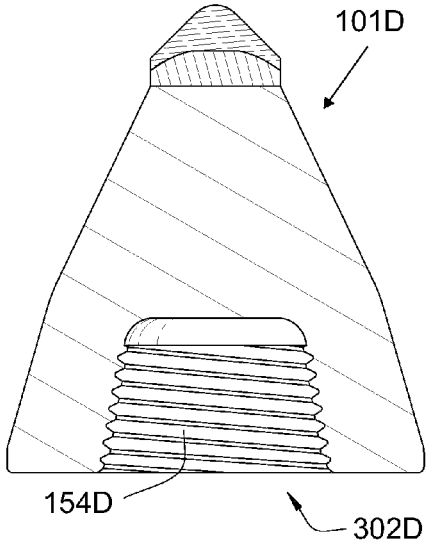
FIG. 1*d* is a cross-sectional diagram of another embodiment of the impact tool.

As shown in FIG. 1*b*, the inside surface 160B of the cavity 302B may comprise a section that tapers inward towards the central axis 165B of the impact tool 101B. The cavity 302B may also comprise a closed end 166B with a portion 152B of the cavity having a widened diameter 161B with a lip 153B.

As shown in FIG. 1 c, the impact tool 101C may include alternative configurations for the lip 153C and wide-diameter portions 152C of the cavity 302C. In yet another aspect of the impact tool 101D shown in FIG. 1*d*, the cavity 302D may also comprise threads 154D. The base end of the bolster may also comprise a flat geometry 151A (FIG. 1*a*), a concave geometry 151C (FIG. 1*c*), a convex geometry 151B (FIG. 1*b*), or combinations thereof.

Figure 2:
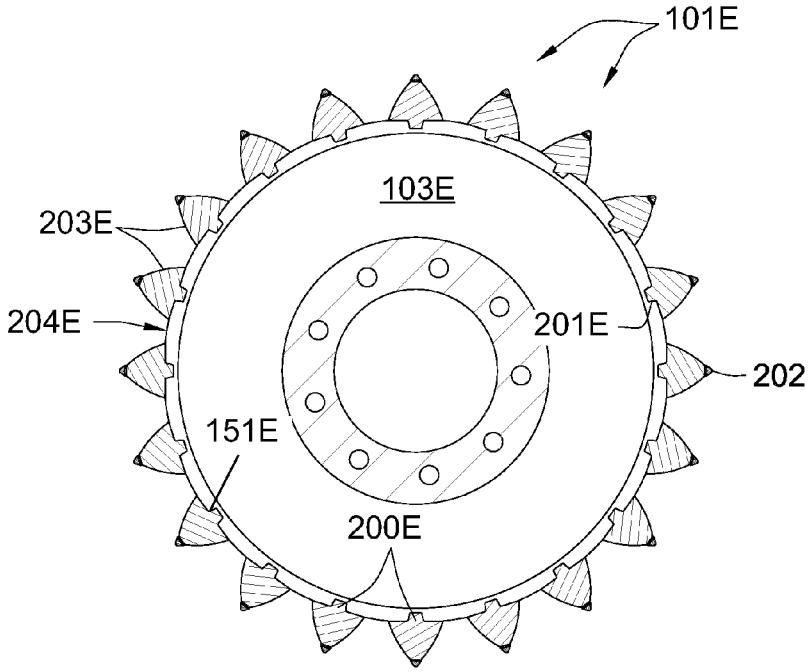
FIG. 2 is a cross-sectional diagram of an embodiment of a driving mechanism that includes a plurality of impact tools disposed on a drum.

FIG. 2 is a cross-sectional diagram of an embodiment of a driving mechanism that includes a plurality of impact tools 101E disposed on a drum 103E. The impact tools 101E may comprise a stem 200E adapted to attach within a recess or groove 201E formed into the outer surface 204E of the drum 103E such as through a press-fit, or with a braze. The impact tools 101E may be spaced less than an inch apart from one another around the drum 103E. In some embodiments the bolsters 203E of the impact tools 101E actually contact each other. The base ends 151E of the bolsters 203E may also be in contact with the outer surface 204E of the drum 103E.

Figure 3:
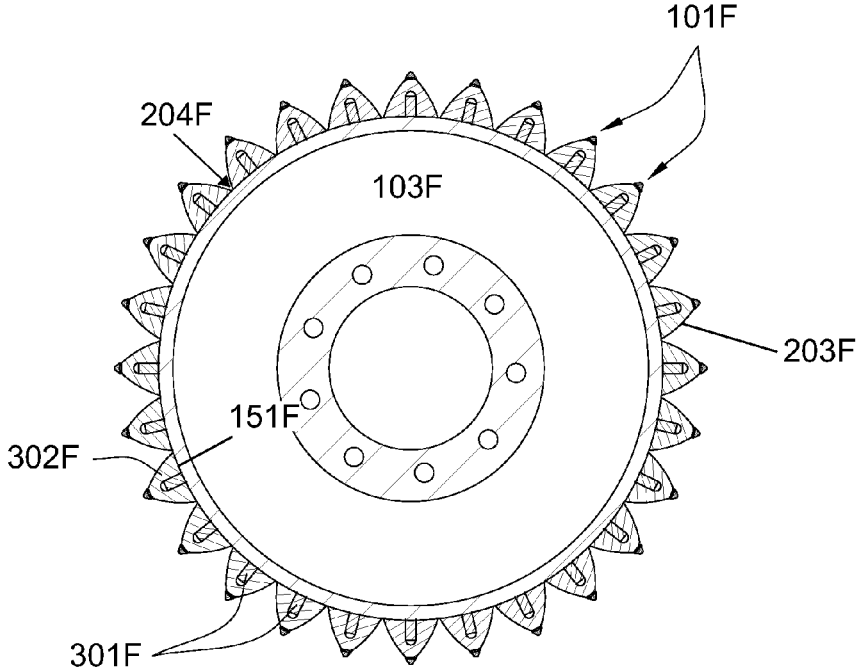
FIG. 3 is a cross-sectional diagram of another embodiment of a driving mechanism that includes a plurality of impact tools disposed on a drum.

FIG. 3 is a cross-sectional diagram of another embodiment of a driving mechanism that includes a plurality of impact tools 101F disposed on a drum 103F. In this embodiment, the drum 103F comprises a plurality of lugs 301F extending from the outer surface of the drum. The distal ends of the lugs fit into the cavities 302F formed into the base ends 151F of the bolsters 203F for attachment. The cavities 302F of the bolsters 203F may be press fit, bonded or threaded onto the lugs. The lugs may be welded to the outer surface 204F of the drum 103F or driving mechanism.

In a preferred embodiment, the impact tools 101F are closely packed together such that the outer surface 204F of the drum 103F is completely covered, or at least the amount of exposed surface is greatly minimized as compared to traditional milling machines. In such embodiments, the outer surface 204F of the drum 103F is protected from the erosive action of cutting into any formation.

One such advantage to the embodiments shown in FIGS. 2 and 3 is their simplicity. In traditional milling applications blocks or holders are welded onto the drums and picks are secured within them. In the present embodiments, holders are not necessary and the abrasion resistant diamond enhanced carbide bolsters are closer to the surface of the drum, which reduced the bending moment typically experienced in traditional milling. Since only wear resistant parts of the tools are exposed to the abrasive nature of milling, the problems with blocks or holders eroding away are negated.

Figure 4:
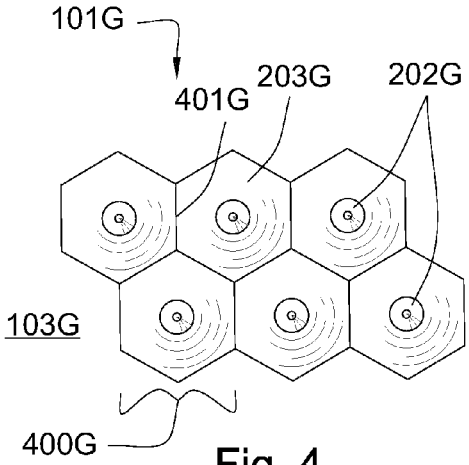
FIG. 4 is a top perspective diagram of another embodiment of a driving mechanism that includes a plurality of interlocking impact tools.

FIG. 4 is a top perspective diagram of another embodiment of a driving mechanism 103G that includes a plurality of interlocking impact tools 101G. Each of the impact tools 101G may comprise an impact tip 202G formed from a super hard material and a cemented metal carbide bolster 203G. The impact tools 101G may also comprise a hexagonal geometry 400G. The impact tools 101G may interlock through one or more flats 401G formed into the sides of the bolsters. By packing the bolsters close together, exposure to the outer surface of the drum or driving mechanism 103G in minimized. Also, by placing the bolsters so close together, the bolsters may support one another when they engage the formation.

Figure 5:
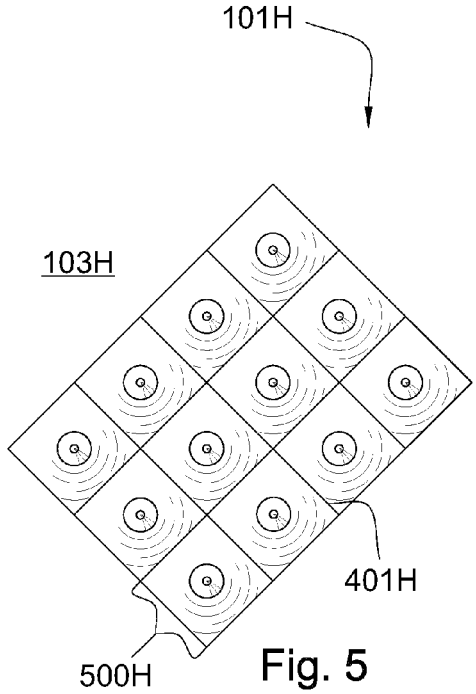
FIG. 5 is a top perspective diagram of another embodiment of a driving mechanism that includes a plurality of interlocking impact tools.

FIG. 5 is a top perspective diagram of another embodiment of a driving mechanism 103H that includes a plurality of interlocking impact tools 101H. The impact tools 101H may comprise a square geometry 500H and may interlock through one or more flats 401H.

Figure 6:
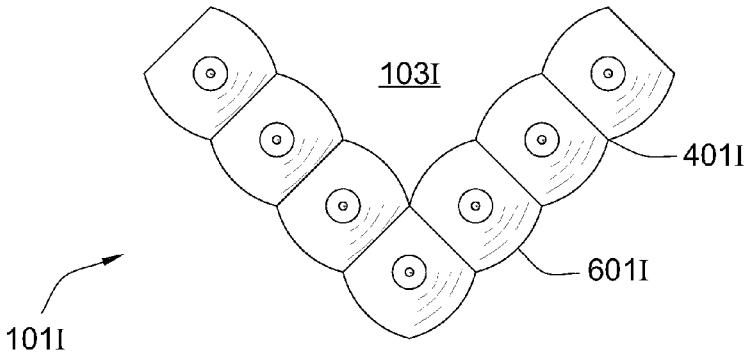
FIG. 6 is a top perspective diagram of another embodiment of a driving mechanism that includes a plurality of interlocking impact tools.

FIG. 6 is a top perspective diagram of another embodiment of a driving mechanism 103I that includes a plurality of impact tools 101I. The impact tools 101I may comprise one or more flats 401I and may interlock through at least one of the flats 401I. The impact tools 101I may also comprise one or more rounded sides 601I. The impact tools 101I may also be disposed in a "V" formation on a drum or driving mechanism 103I.

Figure 7:
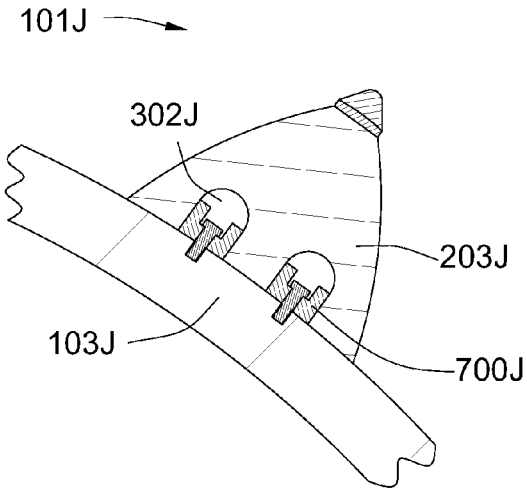
FIG. 7 is a cross-sectional diagram of another embodiment of the impact tool disposed on the surface of a driving mechanism.

FIG. 7 is a cross-sectional diagram of another embodiment of an impact tool 101J disposed on a portion of a drum or driving mechanism 103J. The carbide bolster 203J of the impact tool may also comprise one or more bores 302J, and may be secured against the drum 103J by a ring 700J through a press fit. The ring 700J may be bolted to the drum 103J.

Figure 8:
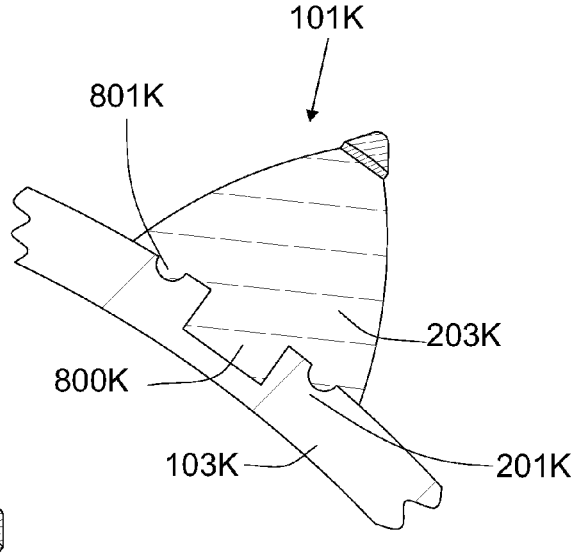
FIG. 8 is a cross-sectional diagram of another embodiment of the impact tool disposed on the surface of a driving mechanism.

FIG. 8 is across-sectional diagram of another embodiment of the impact tool 101K disposed on the surface of a drum or driving mechanism 103K. The drum 103K may comprise a plurality of grooves 201K adapted to receive a middle stem 800K and at least one outer stem 801K of the carbide bolster 203K. The outer stem 801K may be shorter in length and width relative to the middle stem 800K. The outer stem 801K may comprise a concave geometry, and the middle stem 800K may comprise a rectangular geometry.

Figure 9:
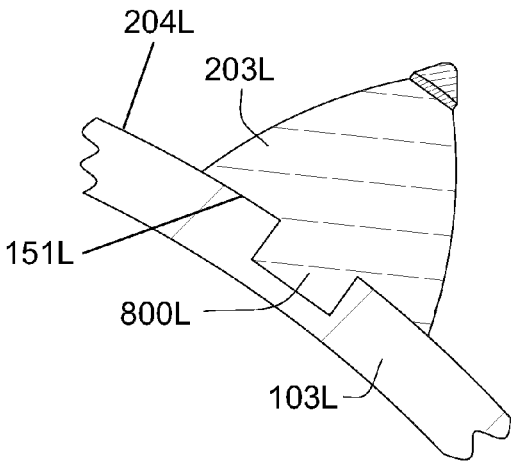
FIG. 9 is a cross-sectional diagram of another embodiment of the impact tool disposed on the surface of a driving mechanism.

FIG. 9 is a cross-sectional diagram of another embodiment of the impact tool 101L disposed on the outer surface of a drum or driving mechanism 103L. The carbide bolster 203L may also comprise one middle stem 800L and may be secured against the drum 103L through a press fit. The base end 151L of the carbide bolster 203L may comprise a geometry that is complementary to that of the outer surface 204L of the drum 103L.

Figure 10:
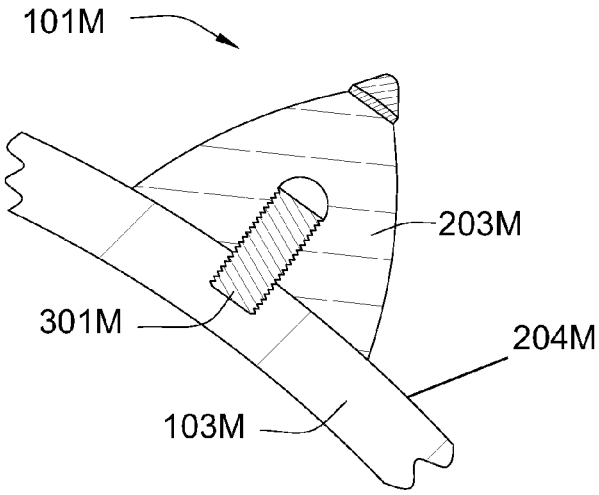
FIG. 10 is a cross-sectional diagram of another embodiment of the impact tool disposed on the surface of a driving mechanism.

FIG. 10 is a cross-sectional diagram of another embodiment of the impact tool 101M disposed on the outer surface 204M of a drum or driving mechanism 103M. The drum 103M may comprise a lug 301M that may be threadedly attached to the drum 103M. The lug 301M may also be threadedly attached to the carbide bolster 203M of the impact tool 101M.

Figure 11:
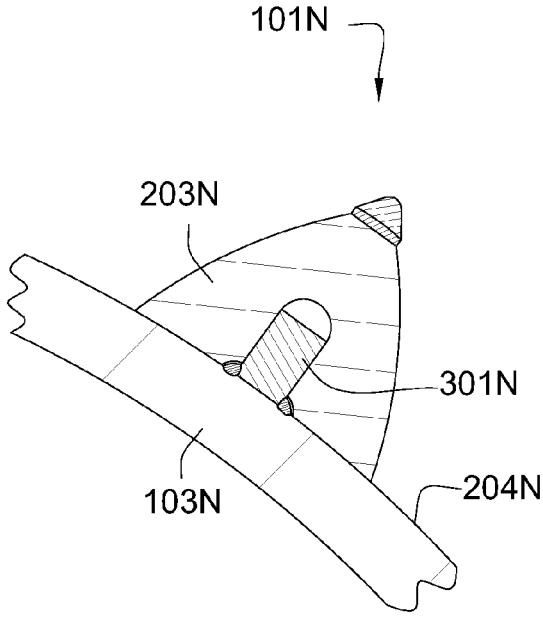
FIG. 11 is a cross-sectional diagram of another embodiment of the impact tool disposed on the surface of a driving mechanism.

FIG. 11 is a cross-sectional diagram of another embodiment of the impact tool 101N disposed on the outer surface 204N of a drum or driving mechanism 103N. The drum 103N may comprise a lug 301N that is welded to the outer surface 204N of the drum 103N. The carbide bolster 203N may be press-fit onto the lug 301N.

Figure 12:
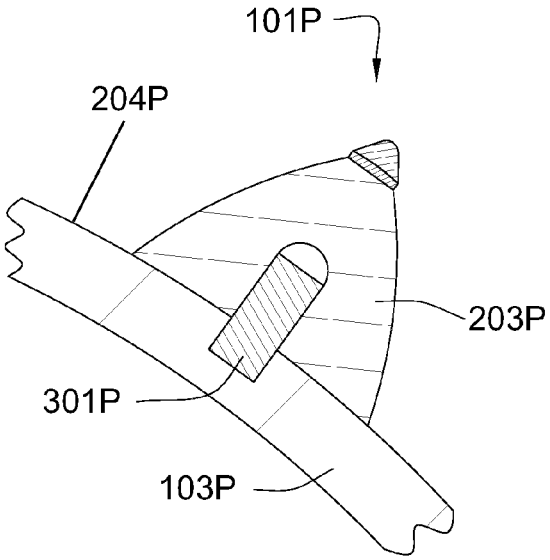
FIG. 12 is a cross-sectional diagram of another embodiment of the impact tool disposed on the surface of a driving mechanism.

FIG. 12 is a cross-sectional diagram of another embodiment of the impact tool 101P disposed on the outer surface 204P of a drum or driving mechanism 103P. The drum 103P may comprise a lug 301P. The lug 301P may be press-fit into the drum 103P. The carbide bolster 203P may be press-fit onto the lug 301P.

Figure 13:
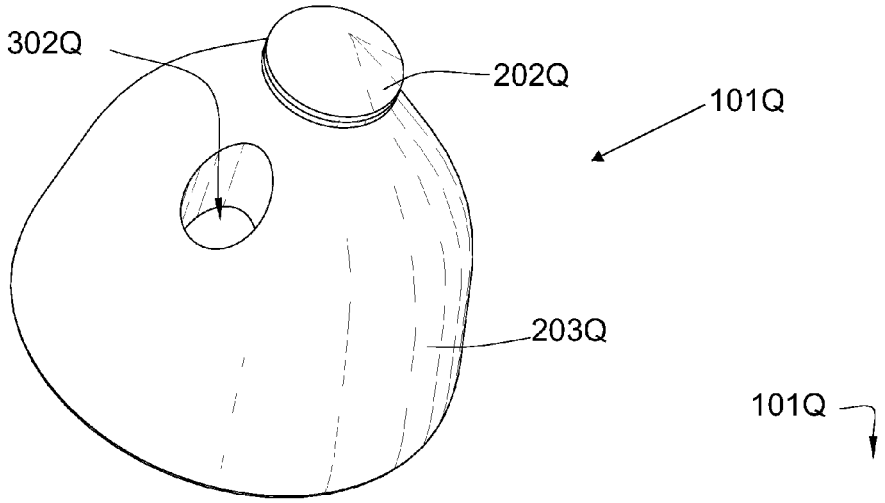
FIG. 13 is a perspective, cross-sectional diagram of another embodiment of the impact tool.
Figure 14:
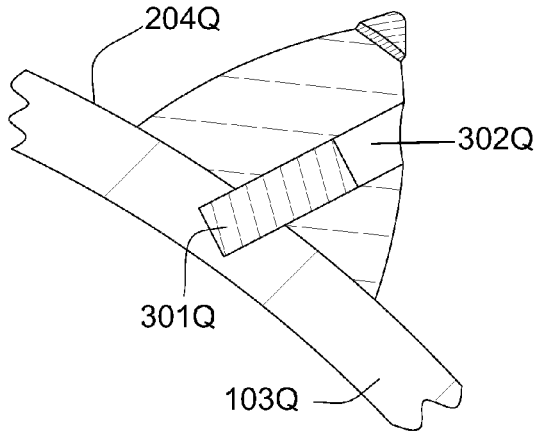
FIG. 14 is a cross-sectional diagram of the embodiment of FIG. 13 disposed on the surface of a driving mechanism.
Figure 15:
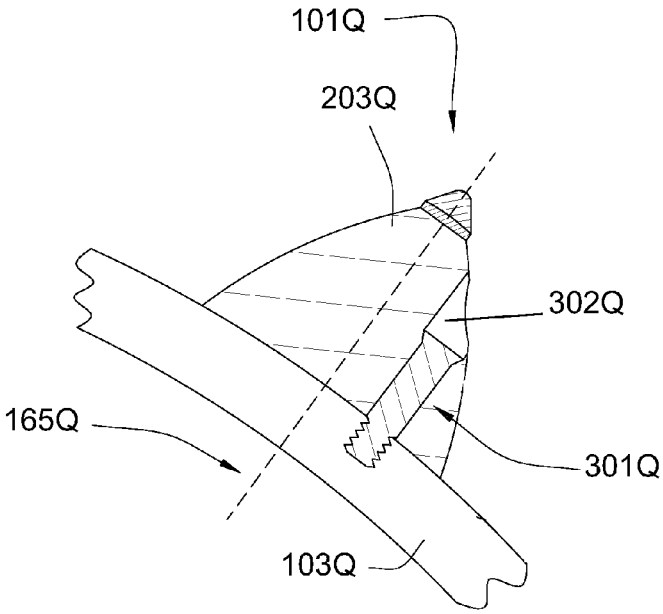
FIG. 15 is another cross-sectional diagram of the embodiment of FIG. 13 disposed on the surface of a driving mechanism.

FIGS. 13, 14 and 15 are a perspective and cross-sectional diagrams of an embodiment of the impact tool 101Q. The carbide bolster 203Q comprises a bore 302Q that may be adapted to receive a bolt 301Q through which the bolster may be attached to the outer surface 204Q of a drum or driving mechanism 103Q. In some embodiments, the bolt may be threaded to just the driving mechanism 103Q, as in FIG. 15, and where the bolt 301Q is generally arranged parallel to a central axis 165Q of the impact tool 101Q. In other embodiments, the bolt 301Q may be threaded to both the drum 103Q and the bolster 203Q, such as in the FIG. 14. FIG. 14 also discloses the bolt positioned at an angle with respect to the central axis of the impact tool. As shown in both FIGS. 14 and 15, the bore 302Q of the carbide bolster 203Q may extend through the carbide bolster 203Q and the bolt/lug 301Q may be inserted through the carbide bolster 203Q to create a press-fit.

Figure 16:
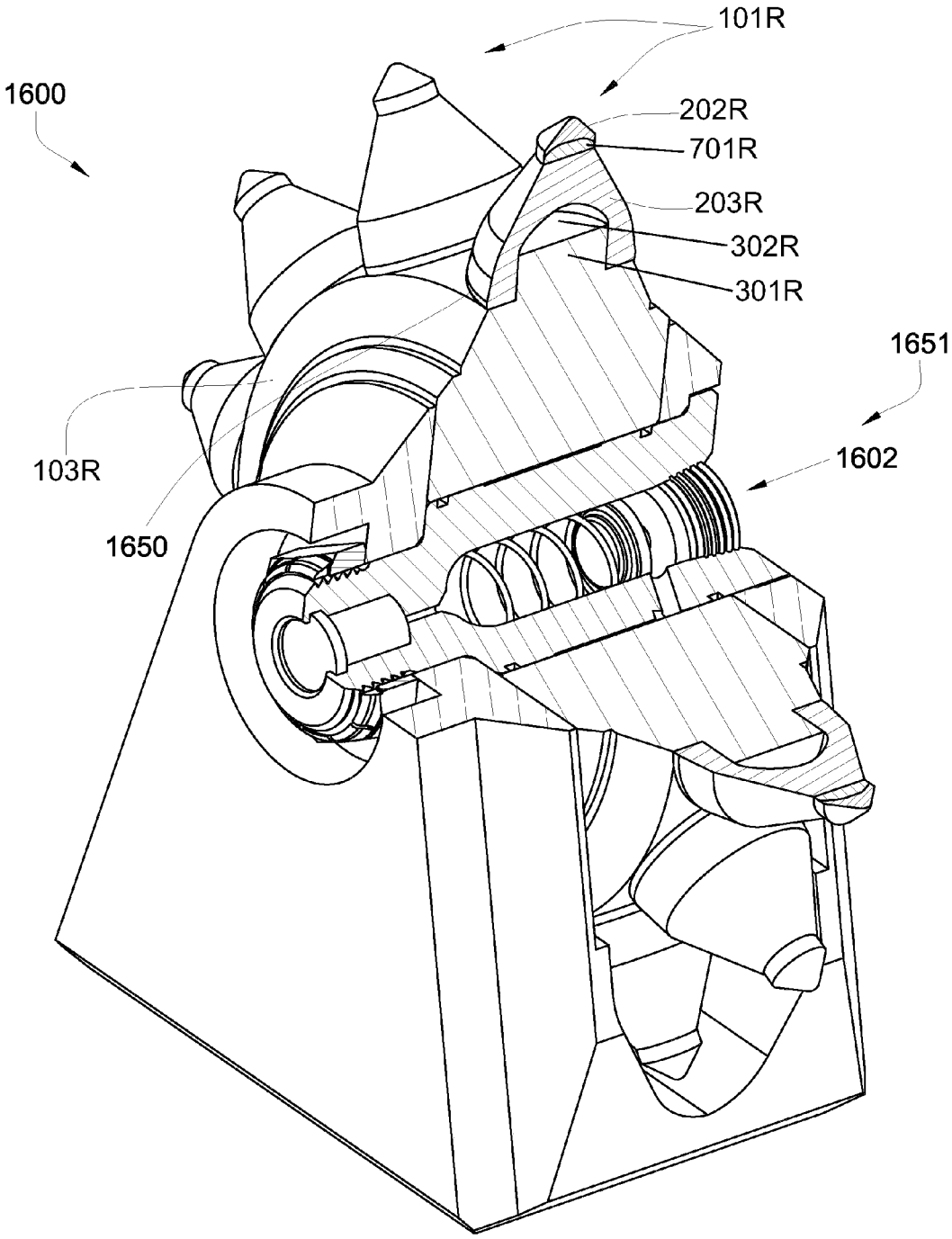
FIG. 16 is a perspective, cross-sectional diagram of another embodiment of a driving mechanism that includes a plurality of impact tools disposed on a roller.

FIG. 16 is a perspective, cross-sectional diagram of another embodiment of a driving mechanism 1600 that includes a plurality of impact tools 101R disposed on a roller or drum 103R. Each of the impact tools 101R may comprise a cemented metal carbide bolster 203R bonded to a cemented metal carbide substrate 701A, which is in turn bonded at a non-planar interface to an impact tip 202R formed from a super hard material. The base end of the bolster 203R includes a cavity 302R which is press fit onto a lug 301R extending from the outer surface of the drum 103R.

The carbide bolster 203R may also include a tapered end 1650R opposite the impact tip 202R. It is believed that such geometry reduces stress risers in the formation which can result in fragmenting the formation. The roller or drum 103R comprises a central axle 1601 about which it rotates. The central axle may comprise an internal accumulator 1602. The accumulator 1602 may comprise a spring, a filter, and a throw-away filter disc, along with an accumulator vent. The accumulator 1602 may act as a lubrication system that includes a lubricating oil. The oil lubricates the central axle 1601 of the drum 103R as it rotates.

Figure 17:
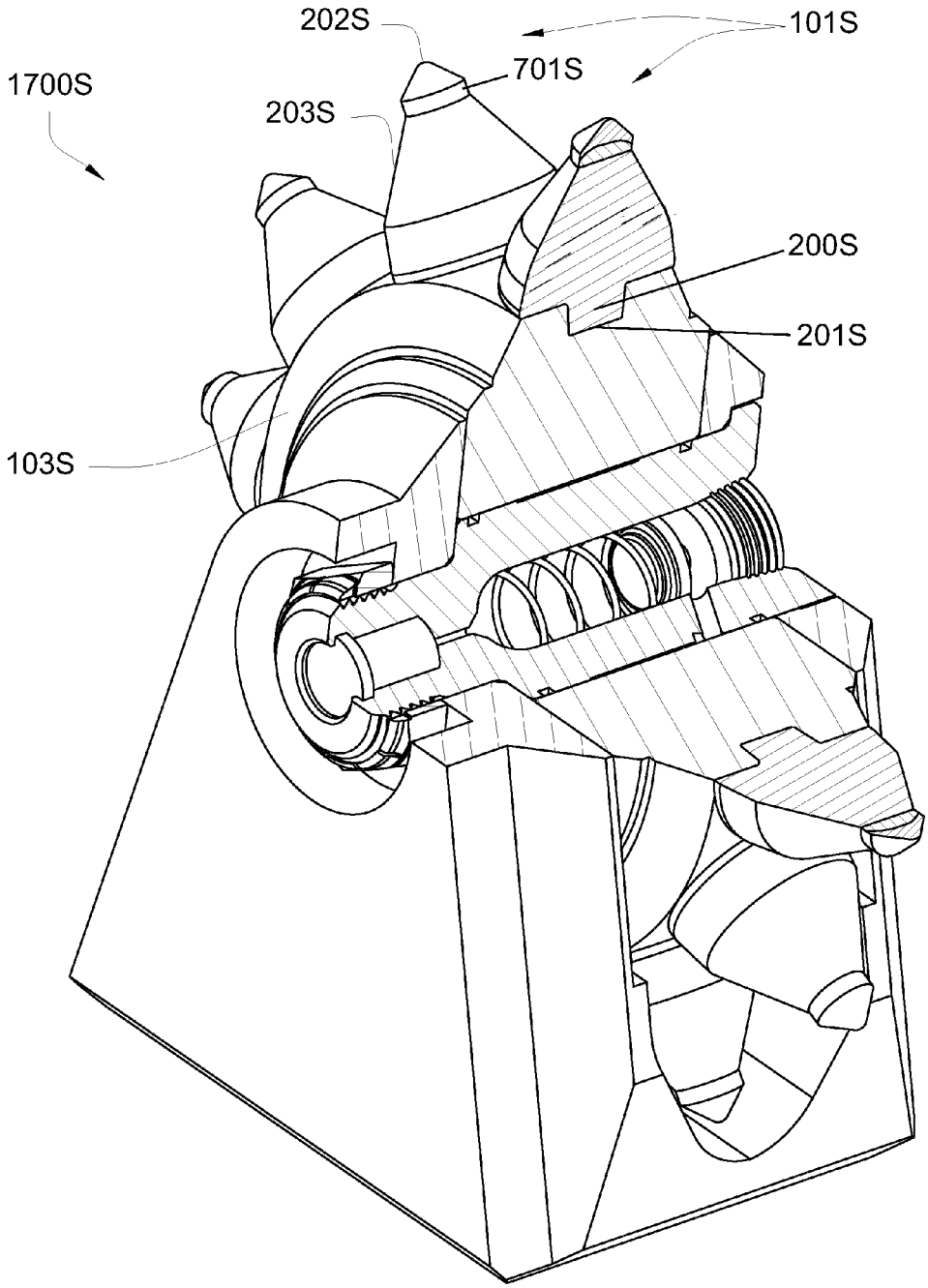
FIG. 17 is a perspective, cross-sectional diagram of another embodiment of a driving mechanism that includes a plurality of impact tools disposed on a roller.

FIG. 17 is another perspective, cross-sectional diagram of an embodiment of a driving mechanism 1700 that includes a plurality of impact tools 101S disposed on a roller or drum 103S. The drum 103S may be part of a roller assembly 1700 that may comprise a plurality of impact tools 101S. The impact tools 101S may each comprise a cemented metal carbide bolster 203S bonded to a cemented metal carbide substrate 701S, and which substrate is in turn bonded to an impact tip 202S formed from a super hard material. The base end of the bolster 203S includes a stem 200S which is press fit into a recess or groove 201S formed into the outer surface of the drum 103R.

Figure 18:
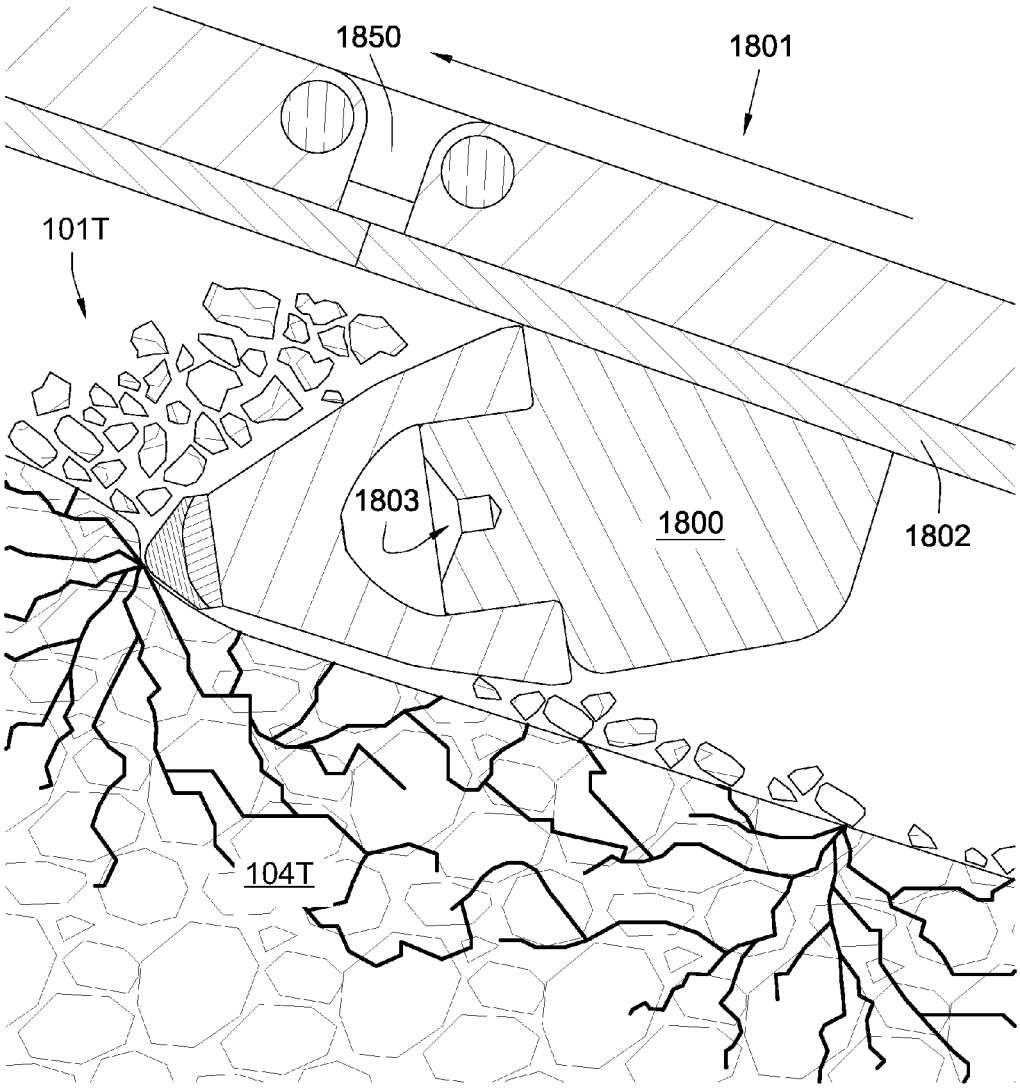
FIG. 18 is a cross-sectional diagram of another embodiment of the impact tool.

FIG. 18 is a cross-sectional diagram of another embodiment of the impact tool 101T disposed on a portion of a driving mechanism or chain 1850, such as a trenching chain. The chain 1850 may comprise a holder 1800 that may be welded to a plate 1802 of the chain 1850, which moves in the direction of the arrow 1801. The holder 1800 may comprise a reentrant 1803 which may create a compliant region. This may allow the impact tool to resist more forces. As the impact tool 101T travels and degrades the formation 104T it carries the formation cuttings along with it, thereby exposing new formation for engagement with adjacent impact tools.

Figure 19:
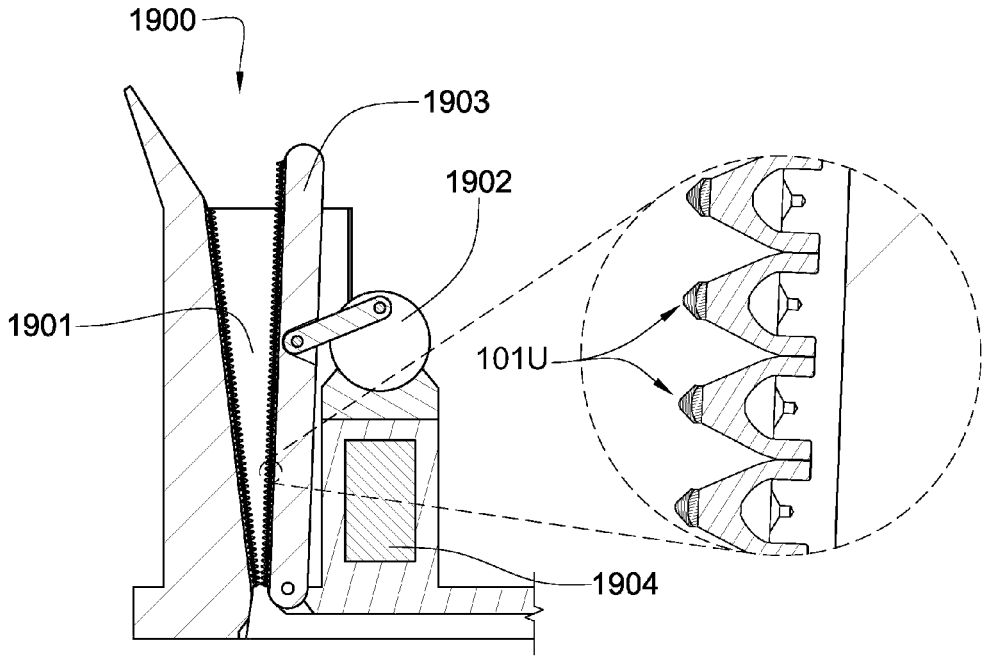
FIG. 19 is a cross-sectional diagram of a degradation machine that includes a plurality of impact tools disposed on a movable wall.

FIG. 19 is a cross-sectional diagram of a degradation machine 1900 that includes a plurality of impact tools 101U disposed on a driving mechanism or movable wall 1903. The degradation machine 1900 may comprise a plurality of impact tools 101U adapted to degrade material within a mouth 1901. The machine 1900 may comprise an axle motion which may aid in degrading the material. The machine 1900 may comprise a cam 1902 attached to athe driving mechanism or wall 1903 of the machine 1900. As the cam 1902 moves it may force the mouth 1901 to close, thereby crushing any material within the mouth 1901. The machine 1900 may comprise a motor 1904 attached to the cam 1902 and adapted to control the cam 1902.

Figure 20:
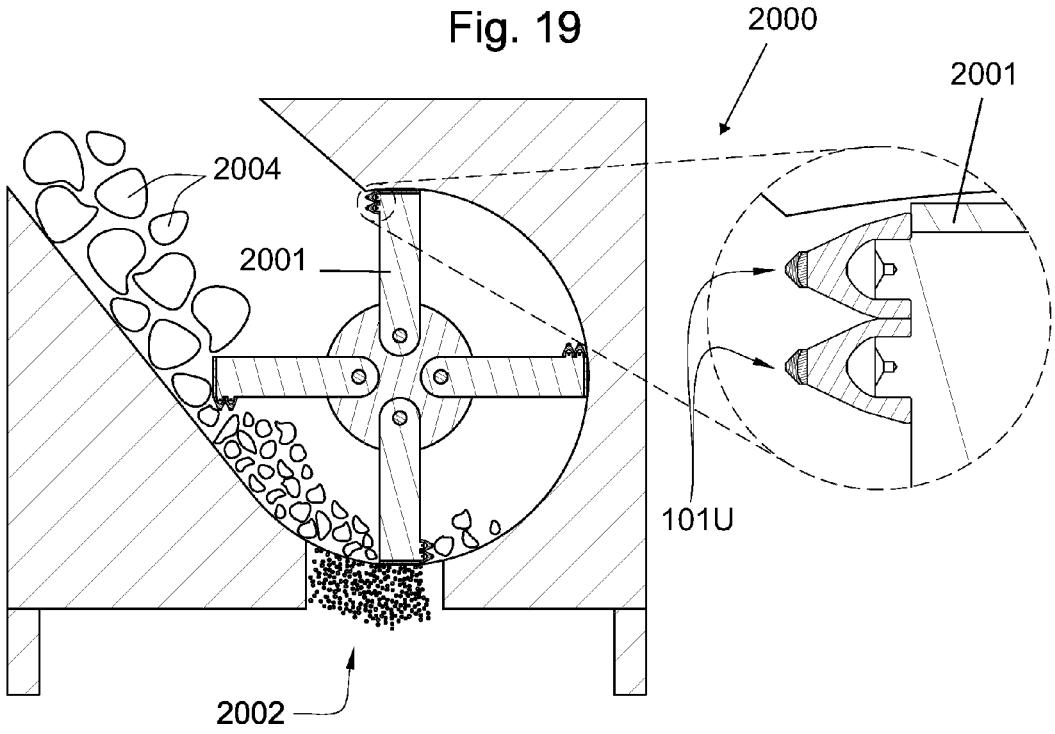
FIG. 20 is a cross-sectional diagram of another embodiment of a driving mechanism that includes a plurality of impact tools disposed on a rotary device.

FIG. 20 is a cross-sectional diagram of another embodiment of a driving mechanism that includes a plurality of impact tools 101U disposed on a rotary mill 2000. Material 2004 may enter the rotary mill 2000 where the plurality of impact tools 101U may degrade it. The rotary mill 2000 may comprise at least one arm 2001. The arm 2001 may comprise at least one tool 101U adapted to degrade the material 2004. The rotary device 2000 may also comprise an exit port 2002 where the degraded material may exit.

Figure 21:
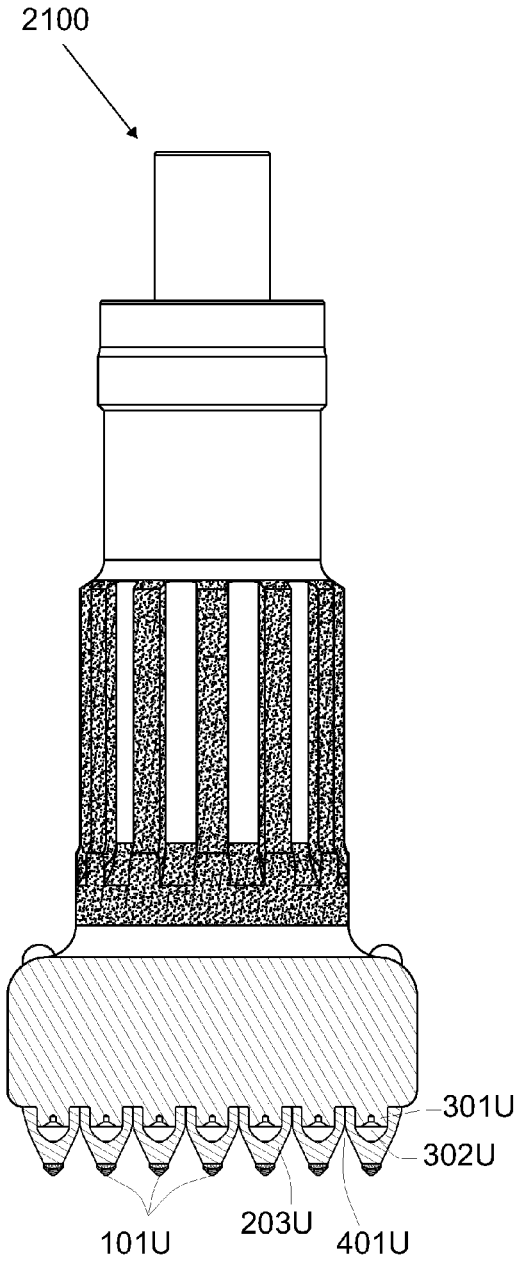
FIG. 21 is a cross-sectional diagram of another embodiment of a driving mechanism that includes a plurality of impact tools disposed on a percussion bit.

FIG. 21 is a cross-sectional diagram of another embodiment of a driving mechanism that includes a plurality of impact tools 101U disposed on a percussion bit 2100. The percussion bit 2100 may comprise a plurality of lugs 301U adapted to attach to the impact tools 101U. Each of the impact tools 101U may comprise a carbide bolster 203U. The carbide bolster 203U may comprise a cavity 302U adapted to attach to the lugs 301U. The percussion bit 2100 may comprise a plurality of impact tools 101U that may interlock through at least one flat 401U.

Figure 22:
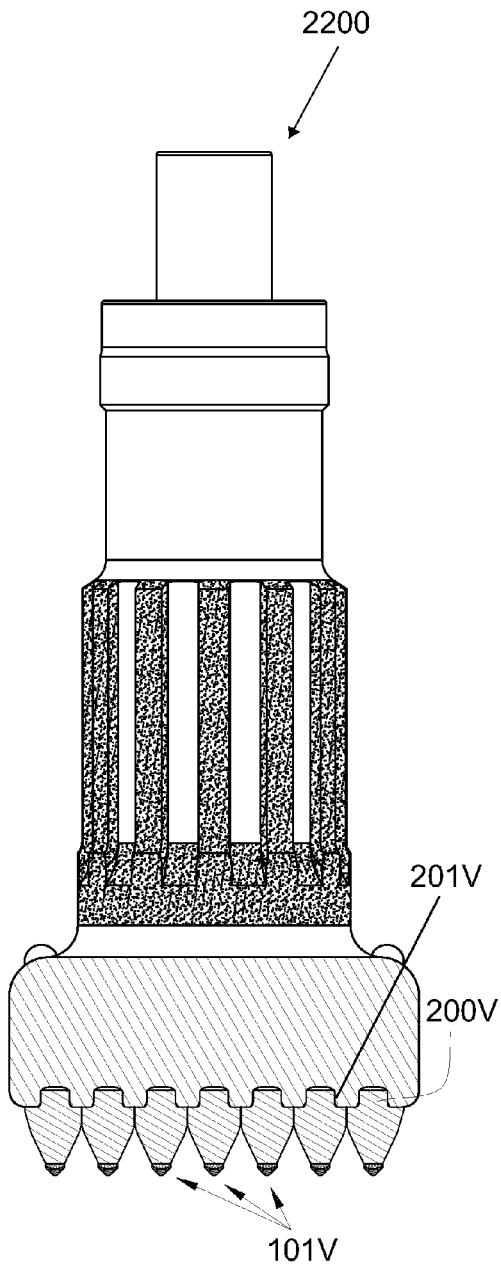
FIG. 22 is a cross-sectional diagram of another embodiment of a driving mechanism that includes a plurality of impact tools disposed on a percussion bit.

FIG. 22 is a cross-sectional diagram of another embodiment of a driving mechanism that includes a plurality of impact tools 101V disposed on a percussion bit 2200. The percussion bit 2200 may comprise a plurality of recesses 201V adapted to receive the impact tools 101V through a press-fit. Each of the impact tools 101V may comprise a stem 200V adapted to interlock with the recesses 201V.

Figure 23:
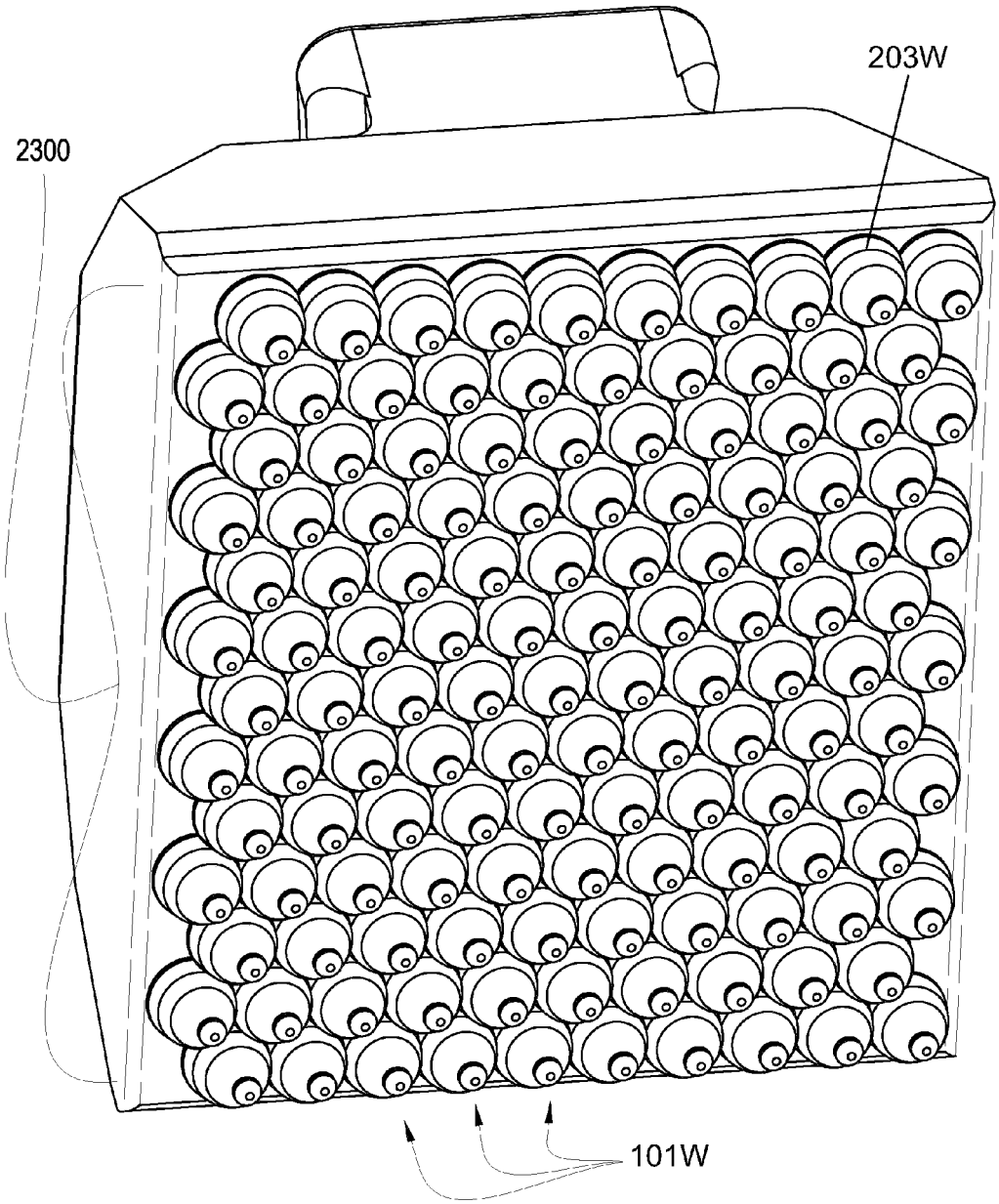
FIG. 23 is a perspective diagram of another embodiment of a driving mechanism that includes a plurality of impact tools disposed on a surface thereof.

FIG. 23 is a perspective diagram of another embodiment of a driving mechanism that includes a plurality of impact tools 101W disposed on a surface thereof. The carbide bolsters 203W of the impact tools 101W may comprise a circular geometry, and may be disposed on a target surface 2300, such as athe target surface 2300 for a vertical shaft mill.

Figure 24:
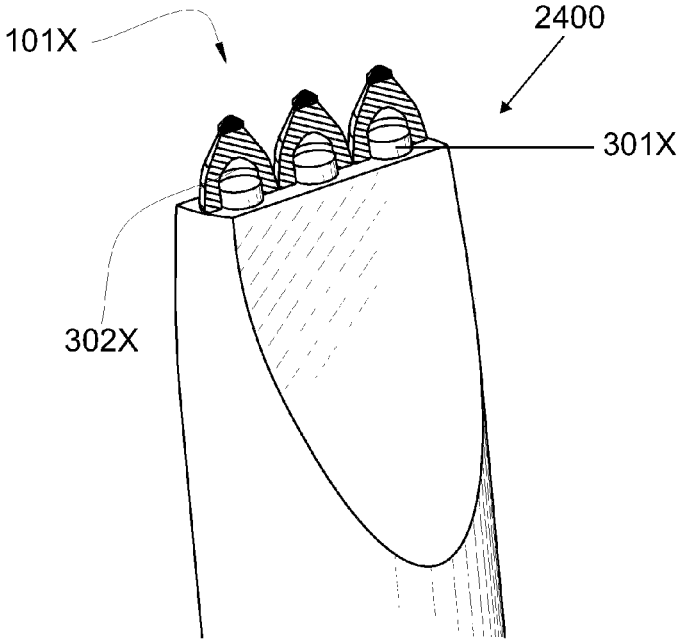
FIG. 24 is a cross-sectional diagram of another embodiment of a driving mechanism that includes a plurality of impact tools disposed on a surface thereof.
Figure 25:
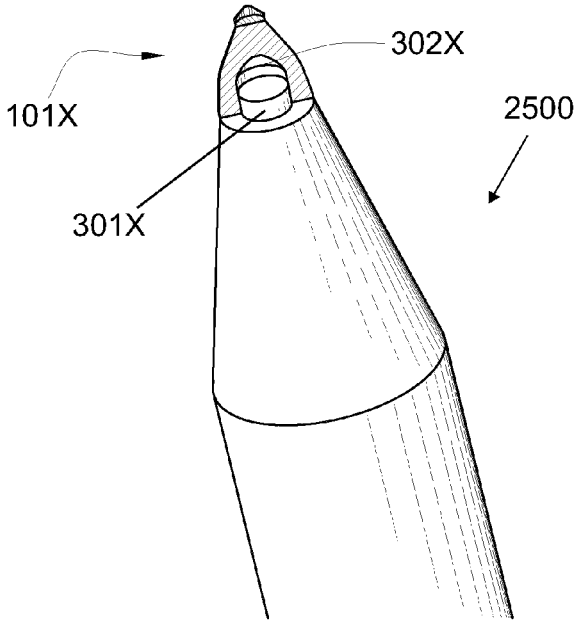
FIG. 25 is a cross-sectional diagram of another embodiment of a driving mechanism that includes an impact tool disposed on a surface thereof.

FIG. 24 and FIG. 25 are cross-sectional diagrams of additional driving mechanism embodiments that include one or more impact tools 101X. In some aspects multiple impact tools may be placed on the end face of a vibrating arm 2400 (FIG. 24), such as a rock breaker adapted to degrade material. In other aspects, a single impact tool 101X may be mounted on the tip of a vibrating arm 2500 (FIG. 25). The impact tool 101X may comprise a cavity 302X that may be press-fit onto a lug 301X extending from the tip of the vibrating arm.

Figure 26:
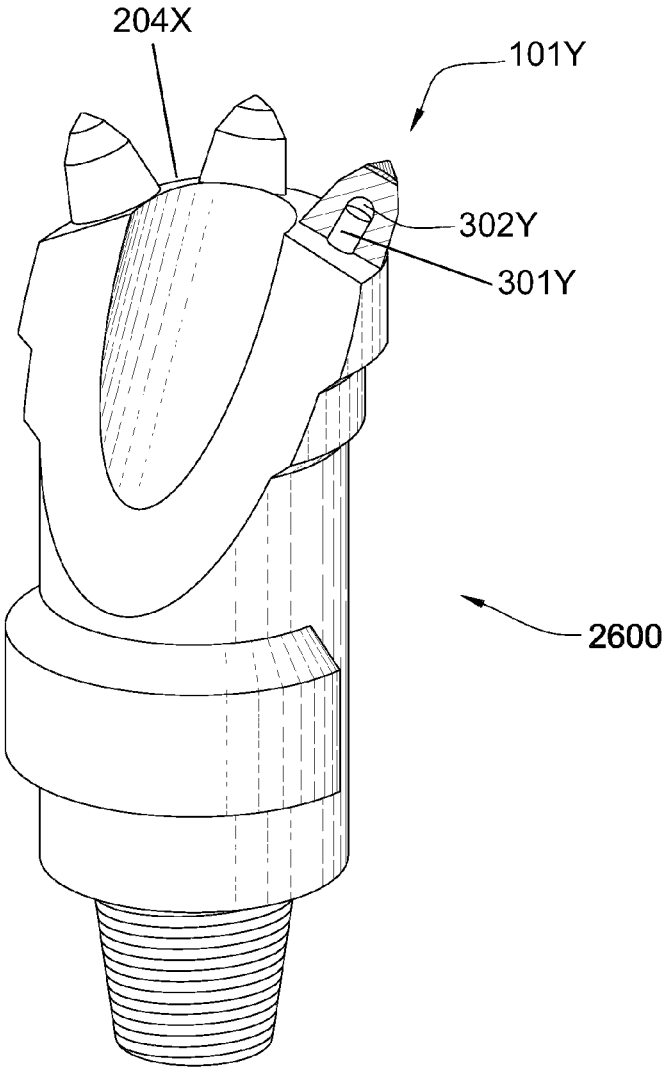
FIG. 26 is a cross-sectional diagram of another embodiment of a driving mechanism that includes a plurality of impact tools disposed on the working surface of a drill bit.

The impact tool 101Y may also be used in a drill bit 2600, as disclosed in FIG. 26. The impact tool 101Y may comprise a bore 302Y adapted to be press-fit onto the lugs 301Y extending from a working surface 204Y of the drill bit 2600. In other embodiments, the impact tools may be incorporated into roller cone bits, water well drill bits, or other types of drill bits.

Figure 27:
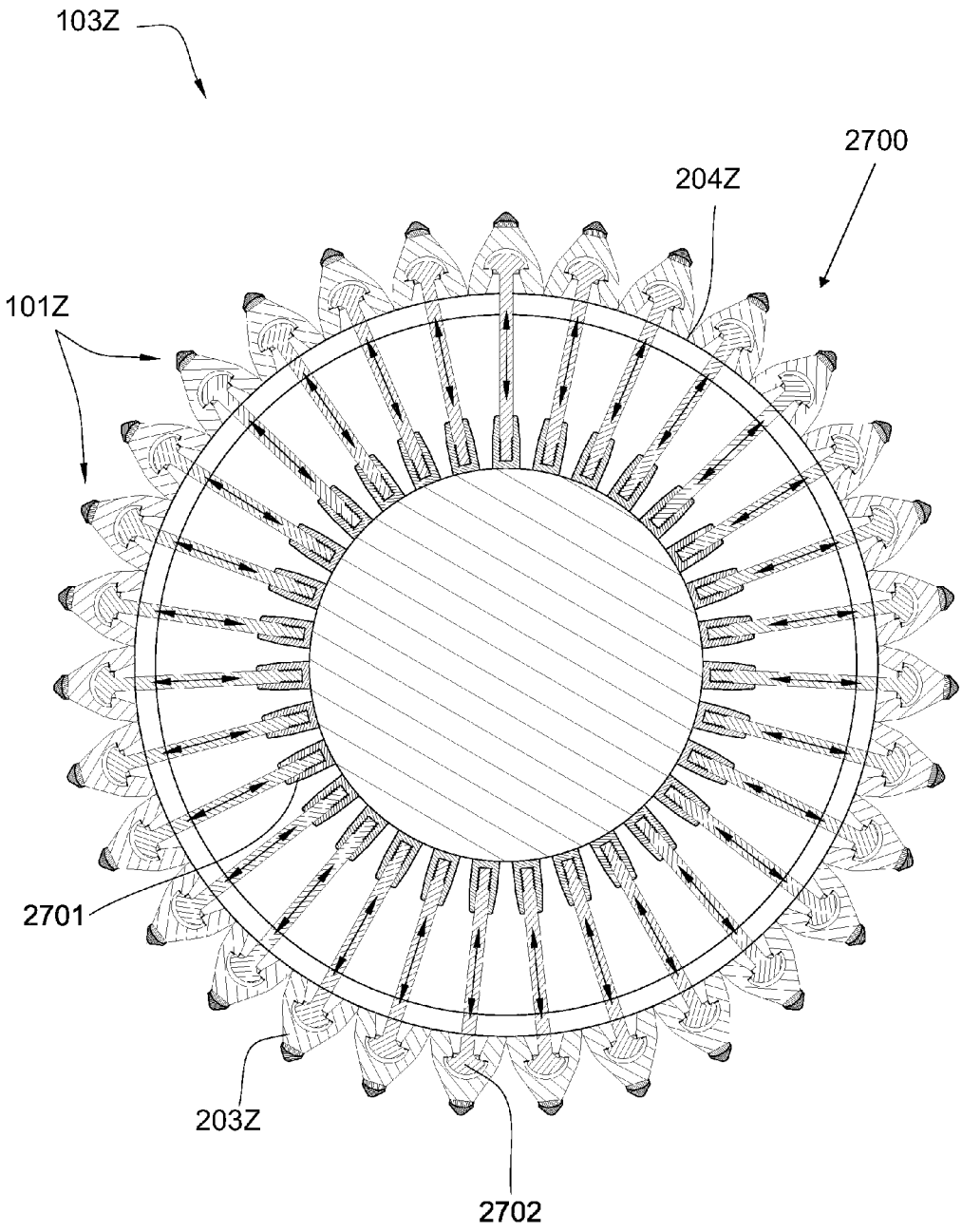
FIG. 27 is a cross-sectional diagram of another embodiment of a driving mechanism that includes a plurality of impact tools disposed on the outer surface of a drum.

FIG. 27 is a cross-sectional diagram another embodiment of a driving mechanism that includes of a plurality of impact tools 101Z attached to the outer surface of a drum 2700. Each of the bolsters 203Z of the impact tools 101Z may be retained by a head of a shank 2702, which shanks includes a distal end that is attached to a hydraulically movable rod 2701. For convenience when it is desirable to replace an impact tool 101Z the hydraulically movable rod 2701 may extend the shank 2702 outward, thereby allowing easy access to the bolster 203Z so that the impact tool 101Z may be replaced.

Whereas the present invention has been described in particular relation to the drawings attached hereto, it should be understood that other and further modifications apart from those shown or suggested herein, may be made within the scope and spirit of the present invention.

What is claimed is:

1. An impact tool, comprising;

an impact tip formed from a superhard material, the impact tip having an apex and an attachment end spaced apart from the apex;

a cemented metal carbide substrate having a first end and a second end spaced apart from the first end, the first end being bonded to the attachment end at a non-planar interface; and a cemented metal carbide bolster having a front end, a base end spaced apart from the front end, and a substantially conical side wall increasing in diameter from the front end to the base end, the front end being bonded to the second end at a planar interface, and the base end having an opening to a cavity formed in the bolster, the opening being coaxial with a central axis of the tool.

2. The tool of claim 1, wherein a diameter of the front end is less than half of a diameter of the base end.

3. The tool of claim 1, wherein a base surface of the base end is substantially flat.

4. The tool of claim 1, wherein a portion of the base end includes an inward taper generally decreasing towards the base end.

5. The tool of claim 1, wherein a base surface of the base end is substantially convex or concave.

6. The tool of claim 1, wherein a diameter of the opening is smaller than a diameter of a portion of the cavity.

7. The tool of claim 1, wherein the carbide bolster comprises at least one flat disposed on its outer surface.

8. The tool of claim 1, wherein the cavity comprises at least one threadform adapted to attach to a threaded shank.

9. The tool of claim 1, wherein a portion of an inside surface of the cavity comprises an inward taper from the opening towards a closed end of the cavity.

10. The tool of claim 1, wherein the impact tip includes a substantially conical surface having a side which forms an angle with a central axis of the impact tool between 35 and 55 degrees.

11. The tool of claim 1, wherein a diameter of the substrate is less than a diameter of the opening.

12. The tool of claim 1, wherein the apex comprises a radius of 0.50 to 0.125 inches.

13. The tool of claim 12, wherein a thickness of the impact tip at the apex is greater than a third of the diameter of the planar interface between the substrate and the bolster.

14. The tool of claim 1, wherein the cavity includes a closed end having a diameter greater than a diameter of the opening in the base end of the carbide bolster.

15. The tool of claim 13, wherein the closed end of the cavity comprises a domed geometry.

16. An impact tool for use with a driving mechanism, said impact tool comprising:

a substrate formed from a cemented metal carbide material, said substrate having a first end and a second end spaced apart from said first end;

an impact tip formed from a super hard material, said impact tip having an apex and an attachment end spaced apart from said apex, said attachment end being bonded to said first end of said substrate at a non-planar interface; and a bolster formed from a cemented metal carbide material, said bolster having a front end and a base end spaced from said front end, said front end being bonded to said second end of said substrate at a planar interface, said base end having an opening to a cavity formed within said bolster, said opening and said cavity being coaxial with a central axis of said impact tool.

17. The impact tool of claim 16, wherein said cavity includes a closed end having a diameter greater than a diameter of said opening.

18. The impact tool of claim 17, wherein a portion of an inside surface of said cavity comprises an inward taper towards a central axis of said impact tool in a direction towards said closed end of said cavity.

19. The impact tool of claim 16, wherein a portion of an outside surface of said bolster proximate said base end comprises an inward taper towards a central axis of said impact tool in a direction towards said base end of said bolster.

20. An impact tool for use with a driving mechanism, said impact tool comprising:

a substrate formed from a cemented metal carbide material, said substrate having a first end and a second end spaced apart from said first end;

an impact tip formed from a super hard material, said impact tip having an apex and an attachment end spaced apart from said apex, said attachment end being bonded to said first end of said substrate at a non-planar interface; and a bolster formed from a cemented metal carbide material, said bolster having a front end and a base end spaced from said front end, said bolster having a substantially conical side wall increasing in diameter from said front end to said base end, said front end being bonded to said second end of said substrate at a planar interface.

* * * * *